United States Patent [19]

Fuld

[11] 3,964,652

[45] June 22, 1976

[54] WATCH BAND AND CONNECTOR THEREFOR

[75] Inventor: Kenneth Fuld, New York, N.Y.

[73] Assignees: Kestenman Bros. Mfg. Co., Providence, R.I.; Major Watch Case Co., Inc., Brooklyn, N.Y. ; part interest to each

[22] Filed: Jan. 17, 1972

[21] Appl. No.: 218,247

[52] U.S. Cl. ..... 224/4 E; 24/265 WS

[51] Int. Cl.[2] ..... A44C 5/16

[58] Field of Search ..... 224/4 E, 4 D, 28 R, 224/28 B, 28 W; 24/265 WS, 265 A, 230 BC

[56] References Cited

UNITED STATES PATENTS 2,536,622 1/1951 Askholt ..... 224/4 E 3,165,884 1/1965 Gwinner et al. ..... 224/4 E X

*Primary Examiner*—Robert J. Spar
*Assistant Examiner*—Jerold M. Forsberg
*Attorney, Agent, or Firm*—Salter & Michaelson

[57] ABSTRACT

A watch band that includes a connector for joining an end of the watch band to a casing of a wrist watch, the connector including a lock element that is located on a lug of the watch casing and that is securable to a connector member fixed to an end of the watch band, wherein the end of the band is removably secured to the lug and is disposed in abutting relation with the casing of the wrist watch.

10 Claims, 14 Drawing Figures

WATCH BAND AND CONNECTOR THEREFOR

BACKGROUND OF THE INVENTION

The present invention relates to a watch band and a connector therefor, wherein the ends of the watch band are removably located in abutting relation with the casing of a watch by the connector.

Wrist bands or bracelets as used with wrist watches have been usually secured to the casing of the wrist watch through pins that are engageable with outwardly extending lugs joined to the watch casing. Such connector constructions have been used for a variety of watches regardless of cost since they quickly facilitated the connection and disconnection of the watch band to and from the watch casing as required. In some instances where the watch band and casing have been of high quality gold materials, the ends of the watch band have been directly secured to the watch casing to produce a one-piece effect. Such prior techniques have employed gold soldering for securing the band ends to the watch housing; but when the watch band had to be replaced or repaired, the disconnecting thereof from the watch casing was difficult to accomplish, and the cost thereof was prohibitive. In some instances connector elements have been employed for connecting the band ends to the watch casing to produce the one-piece effect, but these connector elements known heretofore have been relatively complicated and therefore somewhat expensive to manufacture and/or repair.

SUMMARY OF THE INVENTION

The present invention comprises a watch band construction wherein the watch band includes opposed ends for engagement with the casing of a wrist watch, the watch casing having unitary lugs attached thereto and extending outwardly therefrom. A connector assembly is provided for joining the ends of the watch band to the watch casing, and for this purpose lock elements are located on the lugs and normally project outwardly therefrom. A connector member is joined to each of the band ends and is shaped and proportioned for attachment to a lug; and a lock element is located on each lug and is enveloped by a connector member, the lock element being reversely foldable into engagement with the connector member in which it is located to lock the connector member and the band member to the lug and watch casing. In a preferred form of the invention, the lock element is formed as a separate piece and is replaceable if necessary. In all forms of the invention the lock element includes a portion that is foldable into engagement with the connector member for securing the end of the watch band in abutting relation with the watch casing.

Accordingly, it is an object of the present invention to provide a watch band and connector therefor that includes a lock element that has a portion thereof that is foldable into engagement with a member mounted on an end of a watch band for securing the watch band to the casing of a watch.

Another object of the invention is to provide a connector assembly for joining the end of a watch band to the casing of a watch, wherein a removable lock element is located on a lug joined to the watch casing and is reversely foldable into engagement with a connector member joined to the watch band for locking the watch band to the watch casing.

Still another object is to provide a hollow member that is secured to an end of a watch band and that is securable to a lug joined to the casing of a watch, a lock element being mounted on the lug and being securable to the hollow member for fixing the watch band to the watch casing.

Still another object is to provide a foldable connector for use with a watch band that enables the watch band to be connected and disconnected from the watch casing as required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
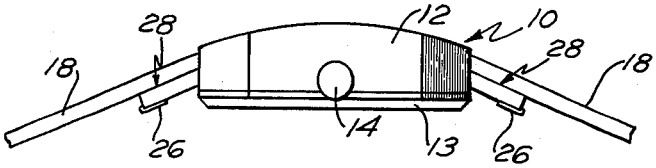
FIG. 1 is a side elevational view of one form of the watch band and connector therefor as embodied in the present invention for use with a wrist watch.

Referring now to the drawing, various forms of the band and connector therefor as embodied in the present invention are illustrated and in this connection are shown for use with a wrist watch. However, it is understood that the invention as illustrated in the drawing may be used with various other bracelet constructions that incorporate an ornamental article therein.

Figure 2:
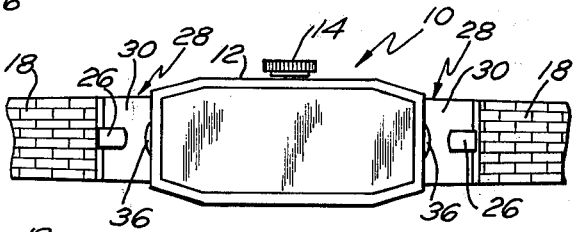
FIG. 2 is a bottom plan view of the watch band and connector illustrated in FIG. 1.

Referring again to the drawing and particularly to FIGS. 1 through 5A, a watch is generally indicated at 10 and includes a casing 12 of any convenient design in which a watch is located, the crystal and crown of the watch being indicated at 13 and 14, respectively, in FIGS. 1 and 2.

Figure 4:
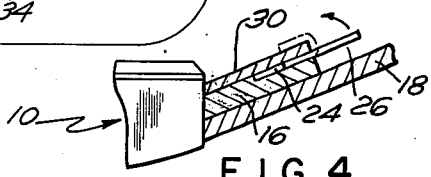
FIG. 4 is a fragmentary side elevational view with parts shown in section of the watch casing and the watch band as joined thereto by the connector assembly illustrated in FIG. 3.

Unlike many of the commonly styled watches known heretofore, the present invention avoids the use of spaced lugs extending from the sides of the watch casing 12 and between which a pin is received. The present invention has particular application for use with a watch band that is located in abutting relation with respect to the casing 12, and it is the intention of the present invention to provide a watch band construction that is associated with the watch casing in such close fitting relation as to give the appearance as being an integral part thereof. In order to accomplish this purpose, unitary lugs 16 are joined to the side walls of the casing 12 in integral relation therewith and may be fixed thereto in any convenient means, such as by soldering, brazing or the like. As illustrated in FIGS. 1 and 4, the lugs 16 are disposed at an angle to the casing 12 and are inclined downwardly with respect to the face of the watch so that when the watch 10 is mounted on the wrist of the wearer the watch band construction interconnected to the watch as will be described may be easily adapted to the wrist of the wearer.

Figure 3:
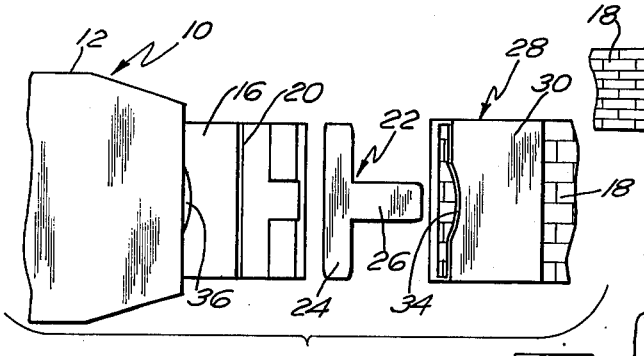
FIG. 3 is an exploded perspective view of the connector assembly for joining the watch band to the watch casing as illustrated in FIG. 2.

As more clearly illustrated in FIGS. 1, 2 and 3, the watch band construction includes separate band members 18 that are preferably formed of a metallic material and that are usually connected at the free ends thereof through a clasp construction or the like for mounting the watch and bracelet on the wrist of a wearer. However, it is understood that if desired the band members 18 may be formed of interconnected links and springs to define a resilient continuous band. In order to secure each of the band members 18 to a lug 16, each lug 16 is formed with a T-shaped notch 20 on the underside thereof, as illustrated in FIG. 3. Formed as a separate element and being removably received in the notch 20 is a lock element generally indicated at 22 that is defined by a head portion 24 and a leg portion 26. The head and leg portions 24 and 26 of the lock element 22 have a T-shaped configuration that corresponds to the T-shaped notch 20, the outer end of the leg portion 26 extending outwardly of the lug 16 when the lock element 22 is located within the notch 20.

Figure 5:
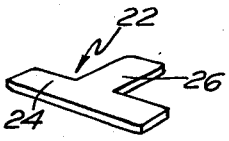
FIG. 5 is a perspective view of the lock element that joins the watch band to the watch casing as illustrated in FIG. 2.
Figure 5A:
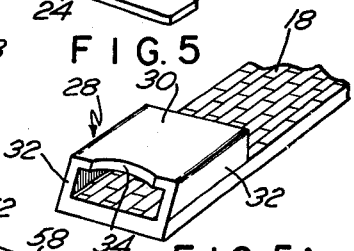
FIG. 5A is a perspective view showing an end of the watch band with a connector member mounted thereon.

The connector assembly for joining a band member 18 to its respective lug 16 also includes a connector element generally indicated at 28; and as illustrated in FIG. 5A, the connector element 28 has a box-like configuration that is defined by a main wall 30 to which side walls 32 are joined at right angles with respect thereto. The side walls 32 are fixed to the band 18 at the outermost end thereof and space the wall 30 from the band to form a hollow box-like member that is open on the ends thereof. A rounded notch 34 is formed in the wall 30 of the connector member 28 and provides access to a projection 36 formed on the watch casing 12 and that is normally used to remove the back cover of the watch casing.

In order to assemble the band members 18 to the watch casing 12, the T-shaped lock elements 22 are located in their respective notches 20, the leg portions of the lock elements 22 extending outwardly of the lugs 16. The open ended connector member 28 of each band 18 is then inserted over a lug 16 and lock element 22 as received in the notch 20 of the lug; and since the lock element 22 is located within the notch 20, the lock element 22 will remain in place in its notch 20 and is then captured therein by the connector member 28 as it slides thereover. After the connector member 28 has been moved to the position illustrated in FIG. 4, the leg portion 26 that extends outwardly therefrom is bent reversely over the wall 30 to the position illustrated in FIG. 2. The lock element 22 thus secures the connector member 28 and the band member 18 joined thereto to the lug 16, the outermost end of the band 18 abutting against the side wall of the casing 12 in the connected position thereof as illustrated in FIGS. 1, 2 and 4.

It is understood that the release of the band members 18 from the watch casing 12 is accomplished by bending back the reversely bent leg portion 26 of the lock element 22 from its locked position, thereby providing for removal of the connector member 28 and the band member 18 joined thereto. If for any reason the lock element 22 cannot be reused, such as for example, when the leg portion 26 is severed from the head portion 24, a new lock element is inserted in place of the broken one and the band member 18 is again secured in place as previously described.

Figure 6:
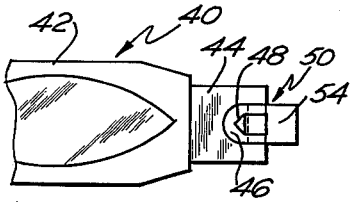
FIG. 6 is a top plan view of a watch casing and lug showing a modified form of connector for joining the end of a watch band to the watch casing.
Figure 7:
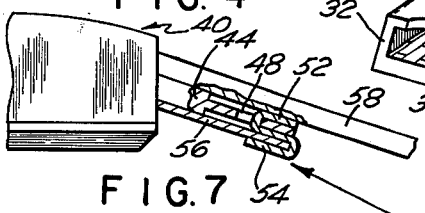
FIG. 7 is a side elevational view with parts shown in section of the modified form of connector assembly illustrated in FIG. 6, after the end of the watch band has been joined to the watch lug.
Figure 8:
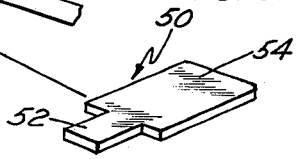
FIG. 8 is a perspective view of the lock element for use in the connector assembly illustrated in FIGS. 6 and 7.

Referring now to FIGS. 6, 7 and 8, a modified form of the invention is illustrated and includes a watch generally indicated at 40 having a casing 42 to the side walls of which outwardly extending unitary lugs are joined, one of the lugs being illustrated in FIGS. 6 and 7 at 44. In this form of the invention, the lug 44 corresponds generally to the lug 16 as described above. Formed in the lug 44 is an indentation 46 that communicates with the end of the lug 44, a triangularly shaped opening 48 being formed in the indentation, and one wall of the triangular opening being parallel to the outer edge of the lug 44. Fixed in the opening 48 is a lock element generally indicated at 50 that includes a reduced finger 52 to which is joined a lock portion 54. The reduced finger 52 extends through the opening 48 in the lug 44 and is bent with respect to the lock portion 54 as illustrated in FIG. 7 so as to secure the lock element 50 to the lug 44. In this position the lock portion 54 extends outwardly of the lug 44 as illustrated in FIG. 6. A connector member 56, generally similar to the connector member 28 described above, is joined to the end of a band member 58 and has a hollow configuration generally corresponding to the connector member 28, which provides for receiving the lug 44 and lock element 50 therein when the band member 58 is secured to the watch casing 42. After the connector member 56 has been inserted fully on the lug 44 so that the outermost end of the band 58 is in abutting relation with respect to the side wall of the casing 42, the lock portion 54 of the lock element 50 is bent over the wall of the connector member 56 to the position illustrated in FIG. 7, thereby fixing the band 58 to the watch casing 42 in close fitting relation thereto.

Figure 9:
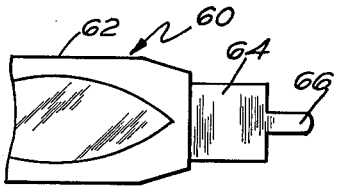
FIG. 9 is a top plan view of another modified form of connector assembly and lock element for use therewith.
Figure 10:
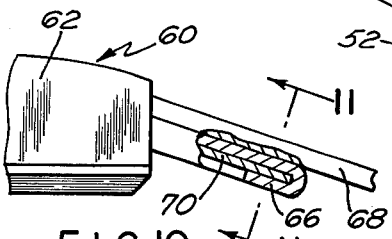
FIG. 10 is an elevational view with parts shown in section of the modified form of the connector assembly shown in FIG. 9, after the securing of a watch band to a lug of a watch casing.
Figure 11:
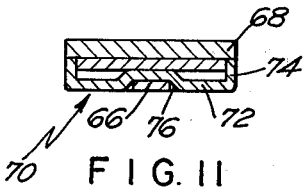
FIG. 11 is a sectional view taken along line 11—11 in FIG. 10.

Referring now to FIGS. 9, 10 and 11, a further modified form of the invention is illustrated and includes a watch generally indicated at 60 having a casing 62 to the side walls of which unitary lugs are joined, one of which is indicated at 64. Unlike the forms of the invention illustrated in FIGS. 1 through 5A and 6 through 8, the lug 64 includes a lock element 66 that is formed as an integral part thereof and thus defines a reduced tab that extends outwardly of the lug. Joined to opposed band members, one of which is illustrated at 68 in FIG. 10, is a connector member 70 having a shape and configuration similar to that described in FIGS. 1 through 5A. The connector member 70 is joined to the outermost end of the band member 68 and includes a main wall 72 to which side walls 74 are joined to form a hollow construction that is opened at the ends thereof. Formed in the wall 72 is a central recess 76 that receives the reduced tab 66 therein as will be described. In the assembly of the band member 68 to the lug 64, the connector member 70 is inserted over the lug 64, the lock tab 66 projecting beyond the inner edge of the connector member 30. Thereafter, the lock tab 66 is bent reversely over the wall 72 of the connector member 70 and into the recess 76 which accommodates the lock tab 66 therein. Removal of the band 68 from the watch 60 is accomplished by prying the lock tab 66 from the groove 76 and then withdrawing the lock member 70 together with the band member 68 joined thereto from the lug 64.

Figure 12:
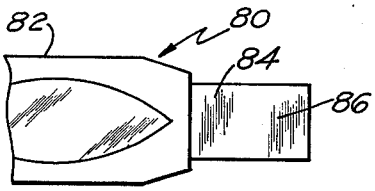
FIG. 12 is a top plan view of a watch casing and connector element showing a still further modified form of the invention.
Figure 13:
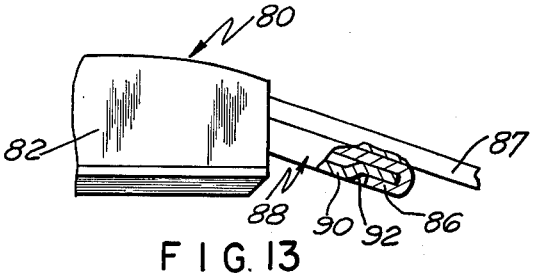
FIG. 13 is an elevational view with parts shown in section of the connector assembly illustrated in FIG. 12, after the securing of a watch band to a lug of a watch casing.

A still further modified form of the invention is illustrated in FIGS. 12 and 13 wherein a watch is generally indicated at 80, the watch including a casing 82 to which lugs are joined at the side walls thereof, one of which is indicated at 84 in FIGS. 12 and 13. The lug 84 is formed somewhat longer than those lugs illustrated and described hereinabove, the outer end of the lug 84 including a lock element 86. Connectable to the lug 84 is a band member 87 to which a hollow box-like connector member generally indicated at 88 is joined in much the manner as described above in the other forms of the invention. A wall 90 of the connector member 88 is deformed at an end thereof to define a laterally extending recess 92 which accommodates the lock element 86 when the band member 87 is to be joined to the casing 82 of the watch 80. In the assembly of the band member 87 to the watch 80, the hollow connector member 88 is received on the lug 84, the lock element 86 projecting beyond the inner edge of the connector member 87. The outwardly extending lock element 86 of the lug 84 is bent over reversely with respect to the lug 84 and into the recess 92 as formed in the wall 90 of the connector member 88. The band 87 is then locked in place and in abutting engagement with the casing 82 of the watch 80. Removal of the band member 87 is accomplished by prying the lock element 86 upwardly to its original position and then sliding the connector member 88 and the band member 87 outwardly of the lug 84.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A watch band construction comprising a band member that includes opposed ends for engagement with a casing of a wrist watch, at least one lug attached to said casing and extending outwardly therefrom, a connector assembly for joining one end of said band member to said casing including a lock element located on said lug and normally projecting outwardly therefrom prior to connection of said one end of the band member to said casing, a connector member joined to said one end of the band member and being shaped and proportioned for securement to said lug and lock element, wherein the connector member abuts said casing and locates said one end of said band member in abutting relation with said casing, said lock element being reversely foldable into engagement with said connector member to lock said connector member and said one end of the band member to said lug and watch casing.

2. A watch band construction as set forth in claim 1, said lock element including an outwardly extending portion that is reversely foldable into engagement with said connector member.

3. A watch band construction as set forth in claim 2, said connector member being hollow in construction and having a box-like configuration wherein the ends thereof are open for accommodating the lug and a portion of said lock element therein.

4. A watch band construction as set forth in claim 2, said lock element being independently formed and separable from said lug, said lug having a notch formed therein for receiving said lock element and for locating said lock element in fixed position thereon when the connector member is inserted thereon.

5. A watch band construction as set forth in claim 4, said independently formed lock element having a "T" configuration that includes a head and a leg portion, the notch in said lug having a corresponding T configuration for receiving the head and leg portion of said lock element therein, the leg of said lock element defining the outwardly extending portion thereof and projecting outwardly of the lug for reverse folding into engagement with said connector member when said lock element and lug are locked to said connector member.

6. A watch band construction as set forth in claim 5, said connector member being hollow in construction and having a box-like configuration, wherein the ends thereof are open for accommodating the lug and lock element therein, the leg of the lock element being reversely foldable into engagement with a wall of the box-like connector member.

7. A watch band construction as set forth in claim 2, the lug having an opening extending therethrough, a portion of said lock element projecting through said opening for securement therein and being connectable to the outwardly extending portion of the lock element.

8. A watch band construction as set forth in claim 7, said connector member being hollow in construction and having a box-like configuration, wherein the ends thereof are open for accommodating the lug and the lock element therein, the outwardly extending portion of the lock element being foldable into engagement with a wall of the box-like connector member.

9. A watch band construction as set forth in claim 2, said outwardly extending portion being formed as an integral part of said lug and being reduced in lateral dimension with respect thereto.

10. A watch band construction as set forth in claim 9, said connector member being hollow in construction and having a box-like configuration, wherein the ends thereof are open for accommodating the lug and outwardly extending portion of the lock element therein.

* * * * *